United States Patent [19]

Knaak et al.

[11] Patent Number: 4,470,808

[45] Date of Patent: Sep. 11, 1984

[54] PUSHING FURNACE FOR HEATING STEEL

[75] Inventors: Rüdiger Knaak, Neuss; Helmut Heuss, Hösel, both of Fed. Rep. of Germany

[73] Assignee: Wistra GmbH Thermoprozesstechnik, Düsseldorf, Fed. Rep. of Germany

[21] Appl. No.: 357,876

[22] Filed: Mar. 15, 1982

[30] Foreign Application Priority Data

Apr. 22, 1981 [DE] Fed. Rep. of Germany ..... 3115930

[51] Int. Cl.[3] ..... F27D 3/02

[52] U.S. Cl. ..... 432/234

[58] Field of Search ..... 432/234

[56] References Cited

U.S. PATENT DOCUMENTS

| | | | |
|---|---|---|---|
| 1,277,356 | 9/1918 | Bagot | 432/234 |
| 3,179,395 | 4/1965 | Esler | 432/234 |
| 3,345,050 | 10/1967 | Guthrie | 432/234 |
| 3,588,059 | 6/1971 | Weineck et al. | 432/234 |
| 4,354,824 | 10/1982 | Campbell | 432/234 |

FOREIGN PATENT DOCUMENTS

| | | | |
|---|---|---|---|
| 491705 | 2/1974 | U.S.S.R. | 432/234 |

*Primary Examiner*—John J. Camby

*Attorney, Agent, or Firm*—Michael J. Striker

[57] ABSTRACT

A pushing furnace for heating steel has a housing with inlet and outlet ends, heating elements in the housing, a plurality of cooled supporting members extending in a longitudinal direction and each having two parts which are offset relative to one another in a lateral direction, and the outlet end part has a length of between 10% and 30% of the length of the furnace, and a plurality of attachment elements arranged on the outlet end part of the supporting elements and including a frame-shaped support placed on the outer end part of the supporting members, a plurality of pressure-resistant heat-insulating intermediate pieces received in the supports, and a metallic slider resting on the intermediate pieces.

11 Claims, 3 Drawing Figures

FIG. 1
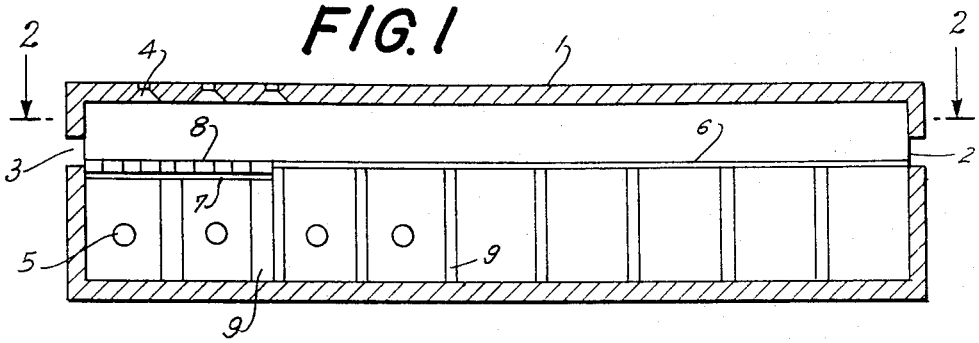
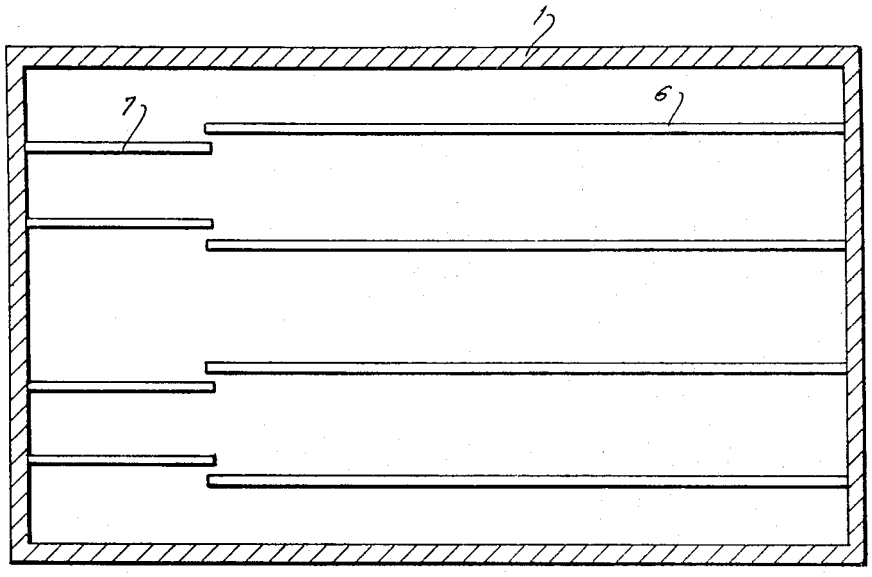
FIG. 2
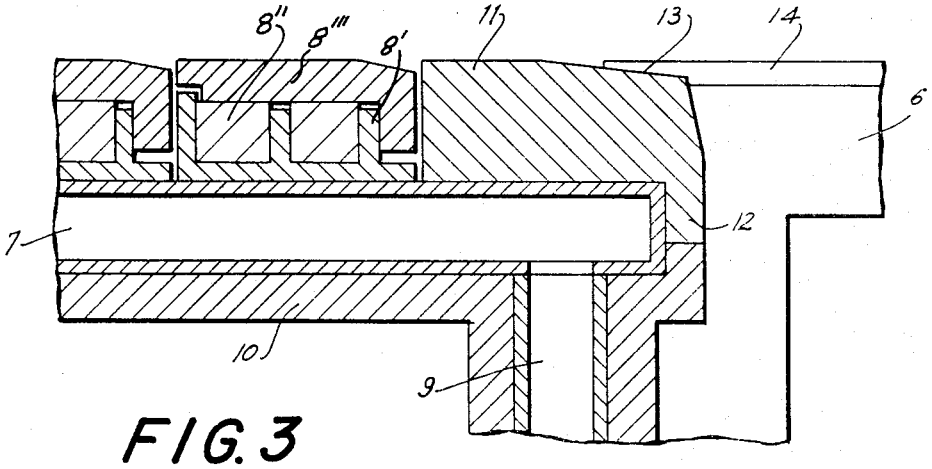
FIG. 3

PUSHING FURNACE FOR HEATING STEEL

BACKGROUND OF THE INVENTION

The present invention relates to a pushing furnace for heating steel, particularly to a rolling temperature.

Pushing furnaces of the above-mentioned general type are known in the art. In a known pushing furnace, an article is heated from above and below by burners and their flue gases. The article to be heated arrests on water-cooled supporting pipes which extend parallel to the longitudinal axis of the furnace from its inlet side to its outlet side. At locations where the article arrests on the water-cooled supporting pipe, the temperature of the article is lower than at other locations, inasmuch as heating at the arresting locations of the article is obstructed and moreover heat is withdrawn to the water-cooled supporting pipe. In order to eliminate the above-mentioned temperature differential, many measures have been taken and implemented.

It is conventional to use metallic attachment members arranged on the supporting pipes so that the article to be heated rests on the attachment members which provides for insulation between the article and the water-cooled supporting pipes. In a simple case, the attachment member is formed as a relatively small prismatic rider which has both low costs and provides for relatively low effect. Improved action is provided by attachment members which are composed of a frame-like holder placed on the pipe, a plurality of pressure resistant heat insulating intermediate pieces embraced by the holder, and a metallic slider provided on the intermediate pieces. This construction is disclosed in the German Pat. No. 1,193,528. The three-part attachment members are however very expensive, particularly because the required heat resistant materials have very high prices.

German Pat. No. 1 583 379 discloses a construction in which the attachment members are arranged only in the rear part of the furnace, as considered in pushing direction of the article. In the front part of the furnace, prismatic heat-conductive sliders are arranged on the pipe. this solution provides for operational advantages. However, it possesses the disadvantage in the fact that for obtaining good temperature equalization in the article, relatively great one-piece metallic attachments (riders) extending over the greater part of the furnace length must be utilized. They have, for example, a cross-section with a height of approximately 140 millimeter and a width of approximately 100 millimeter, in order to provide for a reasonable heat insulation in this region, on the one hand, and a tolerable life time of the attachment members, on the other hand.

It is also known to subdivide the supporting pipes in two parts in the longitudinal direction of the furnace and to offset these parts relative to one another. The advantage of this construction is that the temperature differential which takes place during heating above the supporting rail can be equalized during subsequent placing on the offset supporting pipe, inasmuch as at this location unobjectionable heating from below is performed and cooling through the supporting pipe no longer takes place. It is also known to provide the offset supporting pipes with one-piece metallic attachment members (riders). In this construction excessively high lowering of the temperature in the article above the offset supporting pipe is supposed to be prevented. Because of the offset supporting pipe, a dislocation not only heating of the article by radiation of the furnace space is prevented or obstructed, but heat is also flown from the slab via the supporting face to the cooled supporting pipe. This solution is considered favorable in the sense of the temperature equalization attained and also in the sense of the required expenditures.

However, the proposed solutions are not always satisfactory in the sense of satisfying further increasing requirements to the temperature equalization and particularly to considerably increased energy costs. The one-piece metallic attachment members (riders) provide in many cases for sufficient temperature equalization above the offset supporting pipes. As was recogniced by the current inventors this however is due to the effect that the installation which surrounds the rider at its side press away during practical operation after a short service life, because the rider attached on the supporting pipe on which the insulation is provided makes small movements during the operation. Thereby, the lateral faces of the rider are heated from the furnace. This leads to relatively high temperatures of the rider and thereby to relatively small temperature differential in the article. On the other hand, this leads to the disadvantage in the fact that the hot rider withdraws very much heat to the water cooled pipe. This leads to an undesirable increase of the energy consumption.

SUMMARY OF THE INVENTION

Accordingly, it is an object of the present invention to provide a pushing furnace which avoids the disadvantages of the prior art.

More particularly, it is an object of the present invention to design a pushing furnace which provides for a uniform heating of articles with low energy consumption and low investment costs.

In keeping with these objects and with others which will become apparent hereinafter, one feature of the present invention resides, briefly stated, in a pushing furnace for heating steel which has a housing with axially spaced inlet and outlet ends, heating means for heating the articles in the housing from above and from below, a plurality of cooled supporting members extending substantially in the axial direction and each composed of two parts located at the side of the inlet end and at the side of the outlet end, respectively, and a plurality of attachment elements arranged on the outlet end part of each of the supporting members and including a frame-shaped support, a plurality of pressure-resistant heat insulating intermediate pieces received in the support, and a metallic slider resting on the intermediate pieces.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a view showing a longitudinal section of a pushing furnace in accordance with the present invention;

FIG. 2 is a view showing a section taken along the line A—A of the inventive furnace of FIG. 1; and FIG. 3 is a view showing a fragment B of the inventive furnace of FIG. 1.

DESCRIPTION OF A PREFERRED EMBODIMENT

A pushing furnace for heating steel in accordance with the present invention has a housing which is identified by reference numeral 1. The housing is provided with an inlet opening 2 and an outlet opening 3.

The furnace has heating means which includes a plurality of upper burners identified by reference numeral 4 and provided in the top of the housing, and a plurality of side burners identified by reference numeral 5 and provided in the lower heating space. When an article is introduced into the housing 1 and travels from its inlet side to its outlet side, it is heated from above and from below by the burners and also their flue gases.

The furnace in accordance with the present invention is provided with a plurality of supporting elements extending in a longitudinal direction of the furnace substantially parallel to its longitudinal axis, and arranged to support an article to be heated. Each supporting element has one supporting part provided at the inlet side of the housing and identified by reference numeral 6, and another part provided at the outlet end of the housing and identified by reference numeral 7. The parts 6 and 7 of each of the supporting members are laterally offset relative to one another, preferably by a distance of approximately between 10 and 40 cm. The other part 7 of each supporting element has a length substantially corresponding to between 10 and 30% of the length of the supporting element or the housing. For example, the one part 6 of each supporting element may extend over 80% of the length of furnace. The supporting elements may be formed as water-cooled pipes.

A three-part rider is provided on part 7 of each supporting element, this part extending from of subdivision of the supporting element into two parts 6 and 7 to the outlet opening 3. Reference numeral 9 identifies legs which support the supporting elements, and reference numeral 10 identifies an insulation for the supporting elements and legs.

As can be seen more particularly from FIG. 3, each rider 8 has a frame-shaped support 8' arranged immediately on the part 7 of each of the supporting elements, a plurality of pressure-resistant heat-insulating intermediate pieces 8'' embraced by the support, and a metallic slider 8''' resting on the intermediate pieces.

An attachment member 11 is provided at the end of the part 7 of each supporting element. The attachment members 11 are formed as fixed one-piece prismatic members. Each attachment member 11 has a projection 12 which extends downwardly and is located before the ends of the portion 7 of the respective supporting element, as considered in pushing direction of the article. Each attachment member 11 also has an upper edge with an inclined portion 13 rising upwardly to the normal height of the attachment member. The attachment member 11 has a cross-section which substantially corresponds to the cross-section of the rider 8.

The part 6 of each supporting element, located at the inlet end of the housing, is provided with a wear strip 14 which can be welded to the part 6.

The above-mentioned projection 12 and the inclined portion 13 may be provided on an attachment member which is first as considered in the pushing direction of the article.

The main advantage of the inventive construction is that the three-part attachment element has a considerably better insulation than the one-part metallic rider. This is derived from the fact that the inwardly located pressure-resistant heat-insulating intermediate pieces, generally of ceramic material, have relatively very low heat conductivity. They take up the greater part of the pressure forces, so that the metallic supports require a substantially small cross-section. In the three-part riders the lateral insulation is also under danger because of the unavoidable movements of the rider on the supporting pipe as in the one-piece metallic attachment members. However, the heat withdrawal to the cooled supporting pipes in the event of removed lateral insulation of the rider and heating the side of the three-part rider is substantially lower, inasmuch as the metallic cross-section is considerably smaller. Simultaneously, because of the smaller metallic cross-section, the heat insulation of the three-part attachment member is considerably better. Thereby the temperature equalization in the article to be heated is further improved in desirable manner, and simultaneously the energy consumption by heat flowing through the supporting pipe is reduced.

In accordance with the inventive construction it is required that the hot slab at arriving at the offset part of the supporting elements rests on the three-part rider. This direct running of the slab on three-part rider was considered as disadvantageous by experts, since in the known devices with three-part riders provided in the inlet region of the furnaces it was observed that the rider has a very high wear. Therefore, there was an opinion that the three-part riders are not suitable to support the increased load during running of the slabs.

The construction in accordance with the present invention shows that these problems do not take place when running of the slabs takes place on the three-part riders which are arranged not in the inlet region of the furnace as known in the art, but in the central region of the furnace. These unexpected results can be explained by the fact that in the central region of the furnace a very high but very uniform temperature takes place, whereas the temperature in the inlet region has considerable variations, particularly because of the alternating charging with articles to be heated. It has been determined that in accordance with the invention the three-part rider of the invention, is located in accordance with the requirements of a uniformly high temperature, in such a position that it takes up the pressure of the running slab when the temperature is high, but at the same time uniform. In the event of alternating temperatures, it is subjected as expected to a high wear.

The incorporated insulation of the three-part attachment element acts in such a manner that practically no heat transmission from the article to be heated to the supporting pipe takes place. This feature is very important because the sides of the rider are heated from the hot flue gases, and the heat withdrawal from the rider to the supporting element is practically completely covered from the heating of the sides of the rider. Therefore a longer length of the portion with offset supporting pipes can be provided without an unacceptable temperature reduction above the offset supporting pipes. Therefore also the utilization of a greater length of the furnace post-heating of the region of the article is possible, which previously rested on the supporting pipe, so that also in this region the article can obtain an improved temperature equalization. The length of the offset portion of the supporting pipe can be selected so that in the inlet end central region of the furnace the part of the supporting pipes do not need to be provided with riders and an improved temperature equalization is obtained. Since the attachment elements must be composed of heat-resistant material and thereby are very expensive, manufacturing and operation expenses are reduced.

As mentioned above, a fixed one-piece prismatic attachment member is provided at the end of the part 7 of each supporting element and has a cross-section substantially corresponding to the projection of the three-part attachment element or rider. As described, the articles change in the region of the subdivision of the supporting elements their support and are taken by the offset part 7. As indicated it has been shown that the three-part attachment element can support this particular load in accordance with the invention. However, the first attachment element of the parts 7 of the supporting elements encounters a particular problem when the lower edge of the article is not straight in the horizontal plane, but instead is bent under the action of heat and own weight. In such a situation it is particularly advantageous when the one-piece attachment member 11 is located before the attachment elements or riders 8, more particularly is first in the row, as considered in the pushing direction of the article from the inlet to the outlet of the furnace.

As described above, each one-piece attachment member or rider 11 has the downwardly extending projection 12 at the end of the part 7 of each of the supporting elements. When the article is taken onto the part 7 of the supporting element, the projection 12 serves for transmitting the horizontal force produced during this taking in the pushing direction directly to the supporting pipe. The projection 12 provides for a material cross-section for transmission of the horizontal force, which is many times greater than without it Finally, the attachment member 11, as mentioned above, has the upper edge provided with the inclined portion which rises in the pushing direction to the normal height of the attachment member. This inclination prevents running of the downwardly bent part of the article with its lower edge against the end face of the first attachment element 8 of the part 7 of the supporting element. Otherwise, operational disruptions and damages to the attachment elements for riders 8 could take place.

It will be understood that each of the elements described above, or two or more together, may also find a useful application in other types of constructions differing from the types described above.

While the invention has been illustrated and described as embodied in a pushing furnace for heating steel, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of the present invention.

What is claimed as new and desired to be protected by Letters Patent is set forth in the appended claims:

1. A heating furnace, comprising a housing having a longitudinal axis and a predetermined length in an axial direction, a central region as considered in the axial direction, an inlet and an outlet spaced from one another in the axial direction, and an inlet end and an outlet end adjacent to said inlet and outlet, respectively; means for heating an article to be heated inside said housing from above and from below of the article; means for supporting the article to be heated inside said housing, said supporting means including a plurality of cooled supporting members extending substantially in the axial direction and each subdivided into two parts one of which is located at the side of said inlet end and the other of which is located at the side of said outlet end of said housing and starts at least in said central region of said housing, said other part of each of said supporting members being laterally offset relative to said one part of the same supporting member and having a length of substantially between 10% and 30% of the length of said housing; and a plurality of attachment elements each having a frame-shaped support arranged on a respective one of said supporting members, a plurality of pressure-resistant heat-insulating intermediate pieces received in said support, and a metallic slider resting on said intermediate pieces, said attachment elements being arranged on said other parts of each of said supporting members so that a slab arriving from the one part of said supporting members at the offset other part of the latter rests on said attachment elements and so that said attachment elements start at least from the said central region in which the temperature is high but at the same time uniform, wherefore said attachment elements are not subjected to high wear.

2. A heating furnace as defined in claim 1, wherein said heating means includes a plurality of burners arranged in said housing so that the article is heated inside said housing by said burners and also by their flue gases.

3. A heating furnace as defined in claim 1, wherein said supporting members of said supporting means are formed as water-cooled tubular members.

4. A heating furnace as defined in claim 1, wherein said other part of each of said supporting members is offset relative to said one part of the same supporting member by a distance of substantially between 10 and 40 cm.

5. A heating furnace as defined in claim 1, wherein said one and other parts of each of said supporting members extend parallel to said longitudinal axis of said housing.

6. A heating furnace as defined in claim 1, wherein each of said attachment elements has a predetermined cross-section; and further comprising a plurality of attachment members each arranged on the other part of each of said supporting members in the region of subdivision of the latter, said attachment members having a cross-section corresponding to the cross-section of said attachment element.

7. A heating furnace as defined in claim 6, wherein each of said attachment members is formed as a firm one-piece prismatic member.

8. A heating furnace as defined in claim 6, wherein the other part of each of said supporting members has an end in the region of subdivision of the latter, each of said attachment members having a downwardly extending projection located before the end of the other part of a respective one of said supporting members as considered in pushing direction from said inlet to said outlet.

9. A heating furnace as defined in claim 6, wherein said attachment members is located before said attachment element of each of said supporting members as considered in the pushing direction from said inlet to said outlet.

10. A heating furnace as defined in claim 8, wherein each of said attachment members has an upper edge with an inclined portion rising in pushing direction from said inlet to said outlet.

11. A heating furnace as defined in claim 10, wherein each of said attachment members has a main portion of a predetermined height, said inclined portion rising in the direction from said inlet to said outlet up to said height of said main portion.

* * * * *